US005207129A

United States Patent [19]

Fossella

[11] Patent Number: 5,207,129

[45] Date of Patent: * May 4, 1993

[54] ADJUSTABLE WRENCH

[76] Inventor: Gregory Fossella, 97 Main St., P.O. Box 838, Osterville, Mass. 02655

[ * ] Notice: The portion of the term of this patent subsequent to Nov. 26, 2008 has been disclaimed.

[21] Appl. No.: 893,600

[22] Filed: Jun. 2, 1992

Related U.S. Application Data

[63] Continuation of Ser. No. 638,828, Jan. 8, 1991, abandoned, which is a continuation-in-part of Ser. No. 387,220, Jul. 28, 1989, abandoned, and a continuation-in-part of Ser. No. 392,206, Aug. 10, 1989, Pat. No. 5,067,376, and a continuation-in-part of Ser. No. 567,290, Aug. 14, 1990, Pat. No. 5,090,273.

[51] Int. Cl.[5] ..... B25B 13/46

[52] U.S. Cl. ..... 81/63.2; 81/128; 81/58.4

[58] Field of Search ..... 81/60–63.2, 81/128, 58.4; 279/66, 110, 114

[56] References Cited

U.S. PATENT DOCUMENTS

| | | | |
|---|---|---|---|
| 912,117 | 2/1909 | Green | 81/58.4 |
| 915,443 | 3/1909 | Jones | 81/128 X |
| 3,724,299 | 4/1973 | Nelson | 81/128 |

*Primary Examiner*—James G. Smith
*Attorney, Agent, or Firm*—Wolf, Greenfield & Sacks

[57] ABSTRACT

An adjustable wrench having a housing with a handle and having a plurality of jaws that extend out the bottom of the housing and move radially with respect to one another. The housing contains a control disk which may be locked to the housing to prevent the jaws from turning with respect to the housing. A jaw adjusting disk is disposed beneath the control disk and extends out the bottom of the housing. The adjusting disk contains cams that open and close the jaws depending upon the direction of rotation of the adjusting disk.

66 Claims, 7 Drawing Sheets

ADJUSTABLE WRENCHcl RELATED APPLICATIONS

This application is a continuation of application Ser. No. 07/638828, filed Jan. 8, 1991, now abandoned which is a continuation in-part of my prior co-pending applications Serial Nos. 07/387,220, now abandoned filed Jul. 28, 1989, 07/392,206, filed Aug. 10, 1989, now U.S. Pat. No. 5,067,376, and 07/567,920, now U.S. Pat. No. 5,090,273 filed Aug. 14, 1990. The disclosures of these applications are all incorporated herein by reference.

INTRODUCTION

This invention relates to adjustable wrench heads. The invention may be embodied in either a manually operated wrench or a wrench having a power handle which allows it to be operated both manually and automatically. The wrench head also has application in modular tools with square drives, ratchet handles etc.

The present invention is an improvement over the adjustable wrenches shown in my earlier applications identified above. The wrenches in the earlier applications, supra, are all capable of use with a large range of sizes of nuts and bolts. In application Ser. No. 07/387,220 an adjustable ratchet wrench is disclosed that will accommodate both standard and metric sizes within the range of from 5/16ths to 1 inch in diameter. A similar range of sizes are accommodated by the extension wrench shown in application Ser. No. 07/392,206. Most conventional ratchet and extension wrenches in use today require a large number of interchangeable heads to accommodate workpieces of different diameters. For example, approximately 41 different heads are required to accommodate both standard and metric sizes within the range of from 5/16ths to 1 inch in diameter. An additional equal number of heads may be required if deep bolt clearance is necessary for the work to be performed.

The principal object of the present invention is to provide an adjustable wrench head capable of accommodating a wide range of sizes of nuts and bolts.

Another important object of the present invention is to provide an adjustable wrench head which is suitable for use in manual and power tools and also is suitable for use both as the working head of an extension wrench as well as a ratchet wrench.

Another important object of the present invention is to provide an adjustable wrench head which is relatively small, has relatively few parts, and is stronger and less dependent on tight tolerances than the wrench heads of my prior application supra.

To accomplish these and other objects, the adjustable wrench head of the present invention includes a generally cylindrical housing open at the bottom and at the top, and includes at least two gripping jaws which extend out the open bottom. A control disk is disposed inside the housing and engages the upper ends of the jaws so as to confine the motion to a radial direction with respect to the control disk. The control disk in turn may be selectively locked to the housing with a ratchet assembly which prohibits relative rotation of the control disk with respect to the housing in the selected direction. An adjusting disk is disposed beneath the control disk and is mounted for rotation relative to the housing. At least a portion of the adjusting disk extends out the bottom of the housing and it has a gripping ring which facilitates its rotation by the tool user. The adjusting disk surrounds the jaws, and the jaws and adjusting ring have mating cam surfaces which cause the jaws to move radially toward or away from the axis of the housing when the adjusting disk is rotated. One or more additional cam surfaces are provided on the adjusting disk and the jaws to stabilize them in the housing and prevent the jaws from canting when pressure is applied to their gripping faces by the work piece engaged by them.

In one embodiment of the present invention the housing carries a radially extending handle by which the tool may be turned to rotate the work engaged by the jaws.

In accordance with another embodiment of this invention, the housing is provided with a handle which not only may function to turn the tool manually but also contains a power pack for automatically driving the tool.

In accordance with other embodiments of this invention the control disk may also function as the housing and include means for connecting the head to a square drive, ratchet drive or other inputs.

These and other objects and features of the present invention will be better understood and appreciated from the following detailed description of several embodiments thereof, selected for purposes of illustration and shown in the accompanying drawings.

BRIEF FIGURE DESCRIPTION

Figure 2:
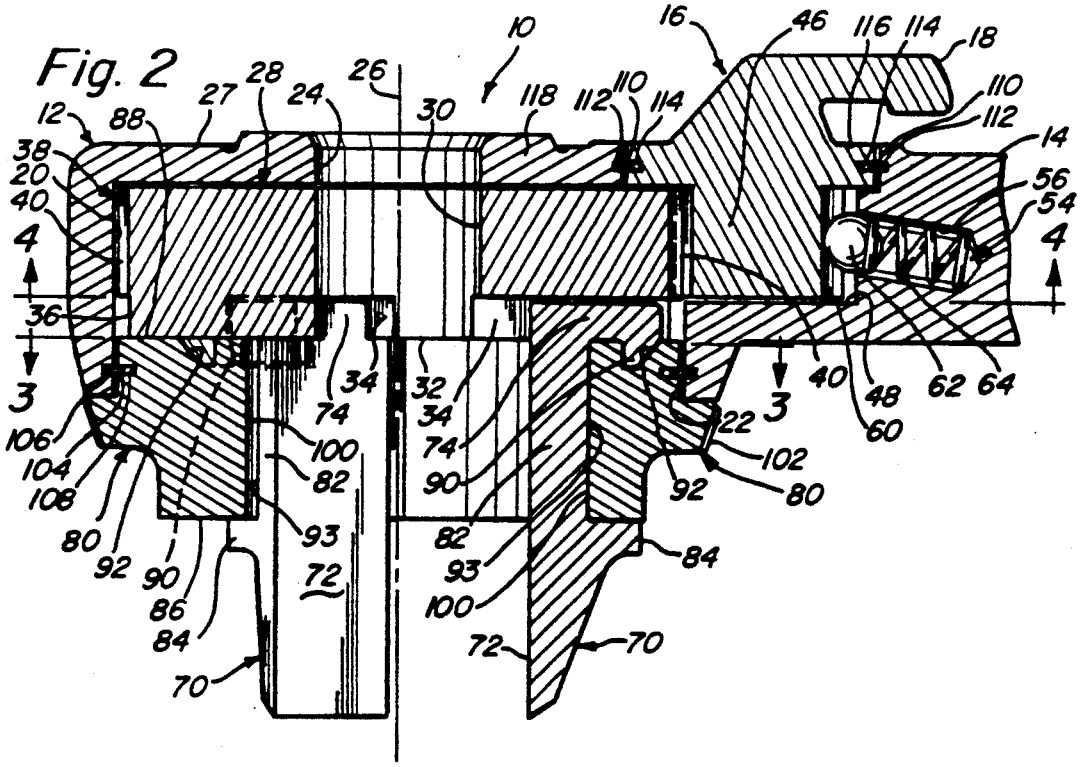
FIG. 2 is a vertical cross sectional view of the ratchet wrench of FIG. 1 taken across a diameter of the wrench head.
Figure 3:
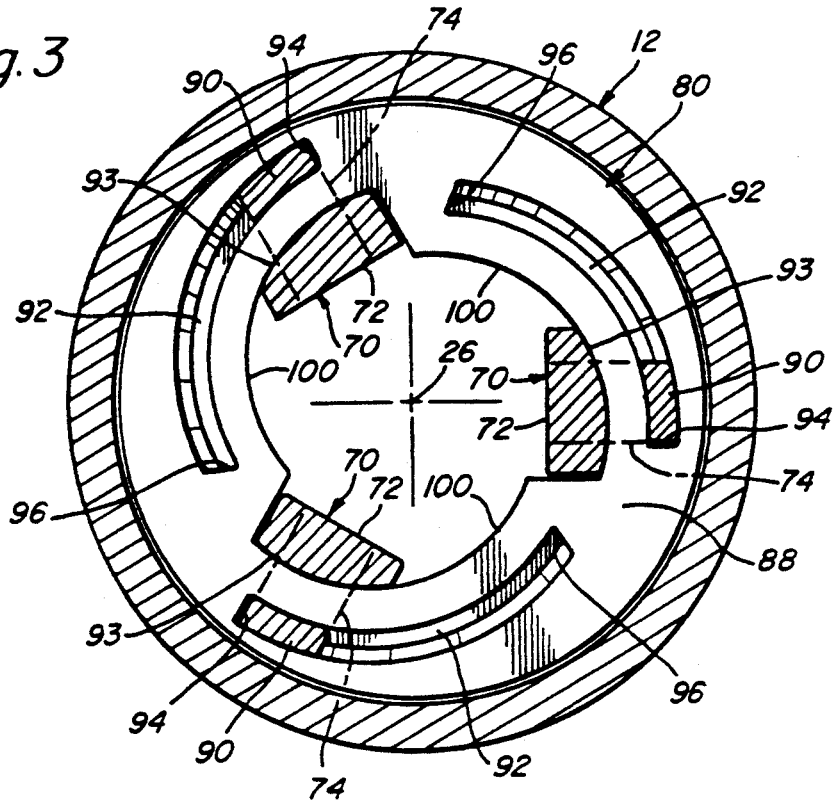
Figure 4:
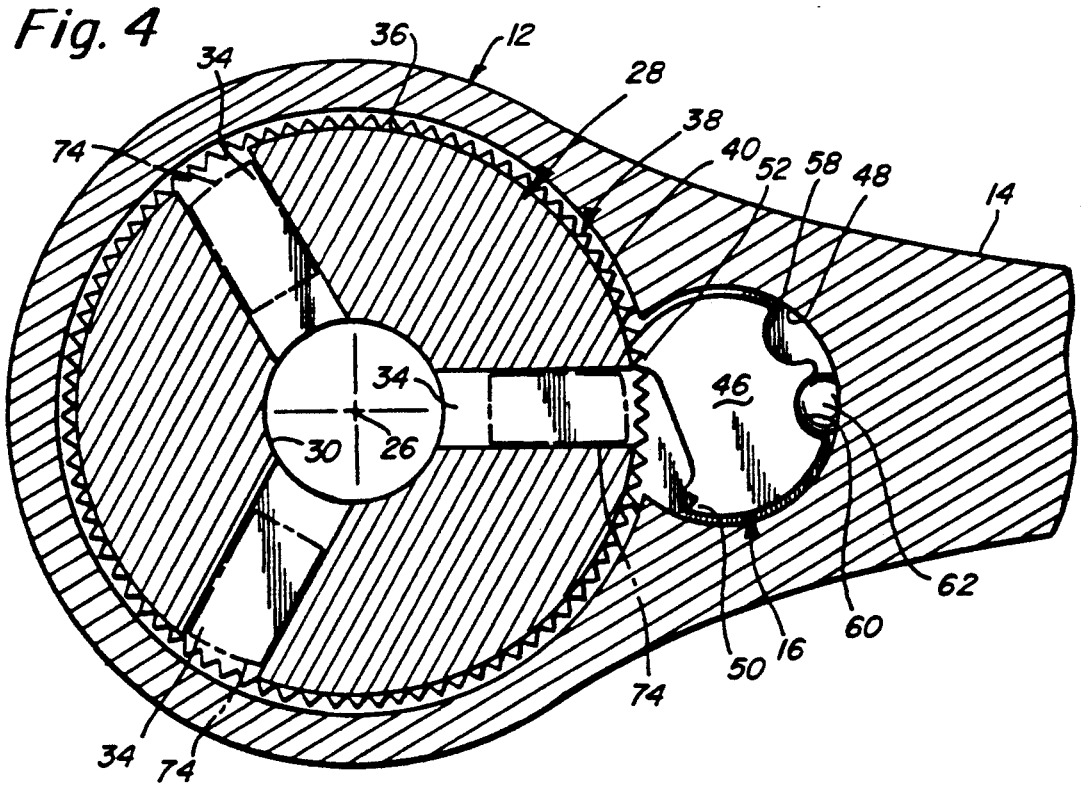
Figure 5:
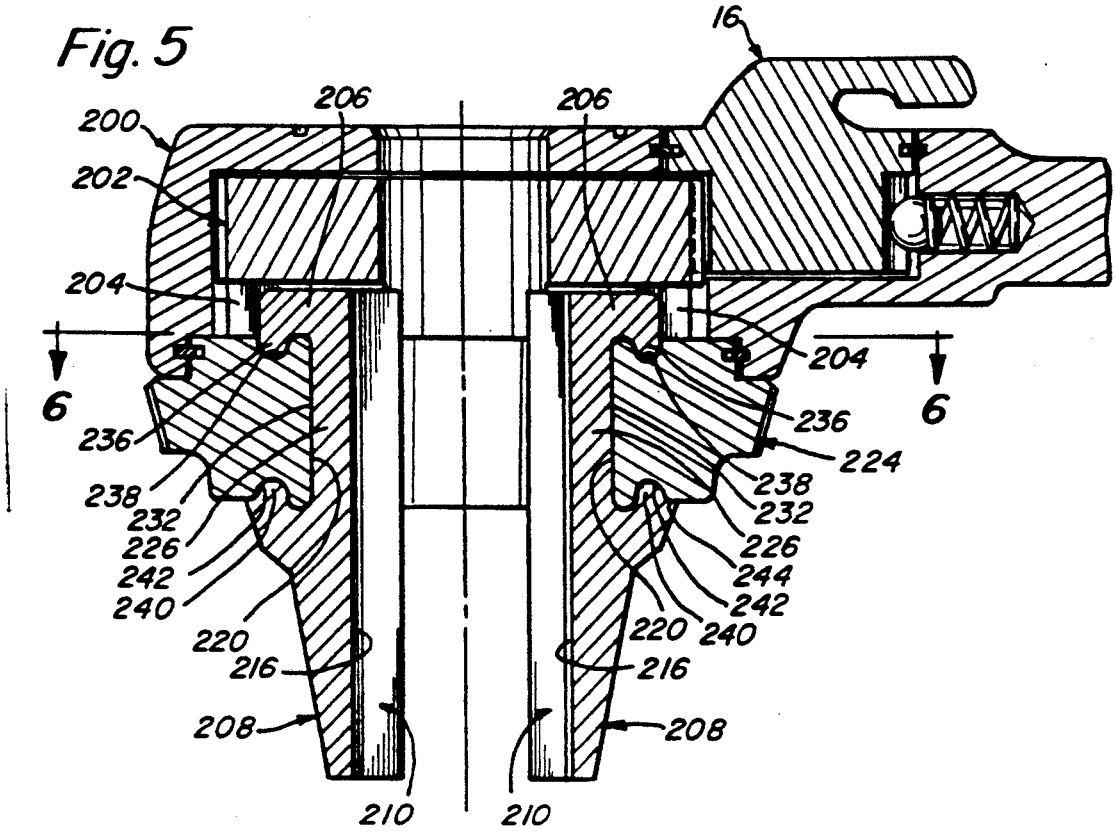
Figure 6:
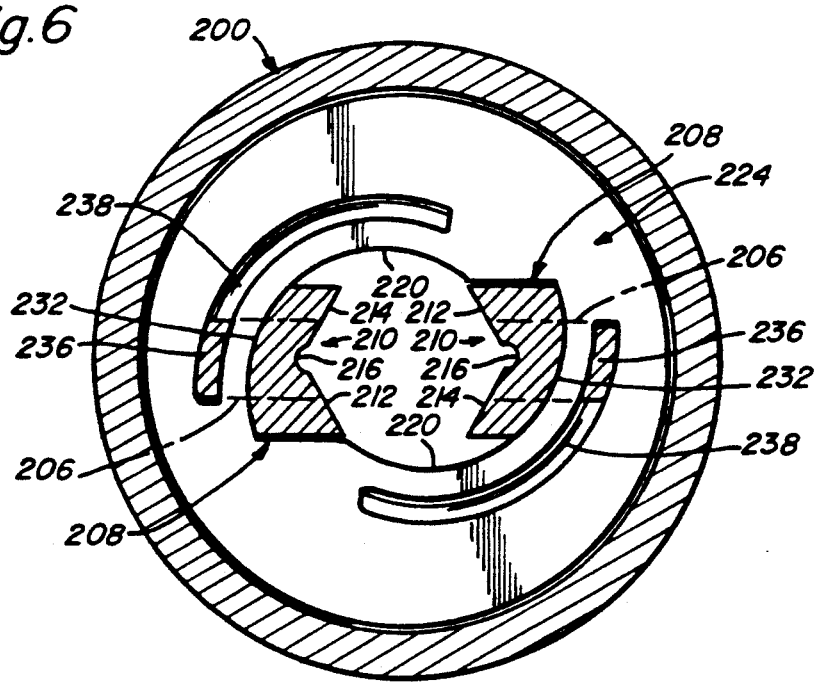
Figure 7:
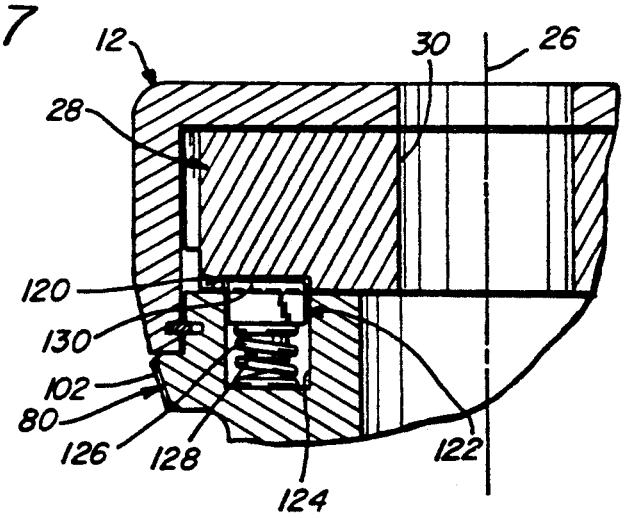
Figure 8:
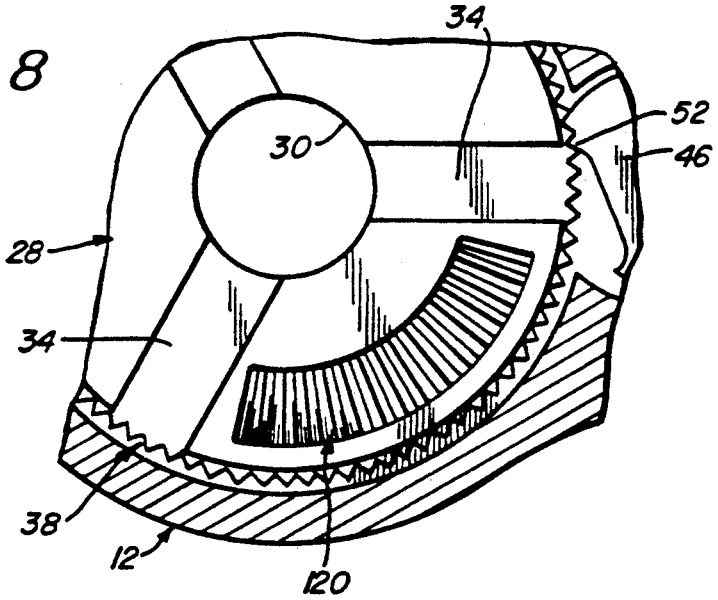
Figure 9:
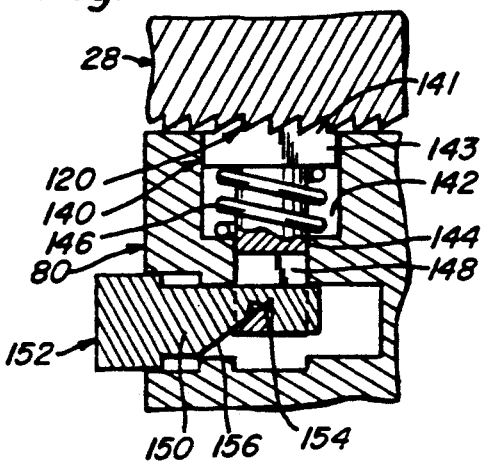
Figure 10:
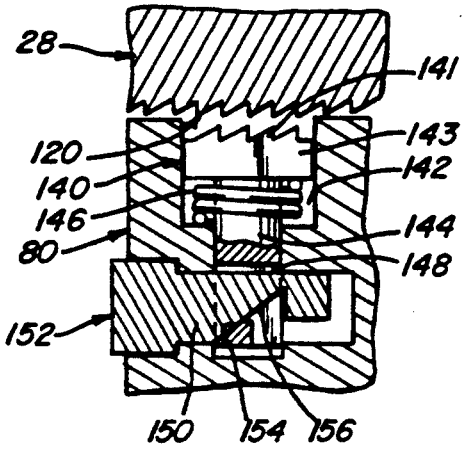
Figure 11:
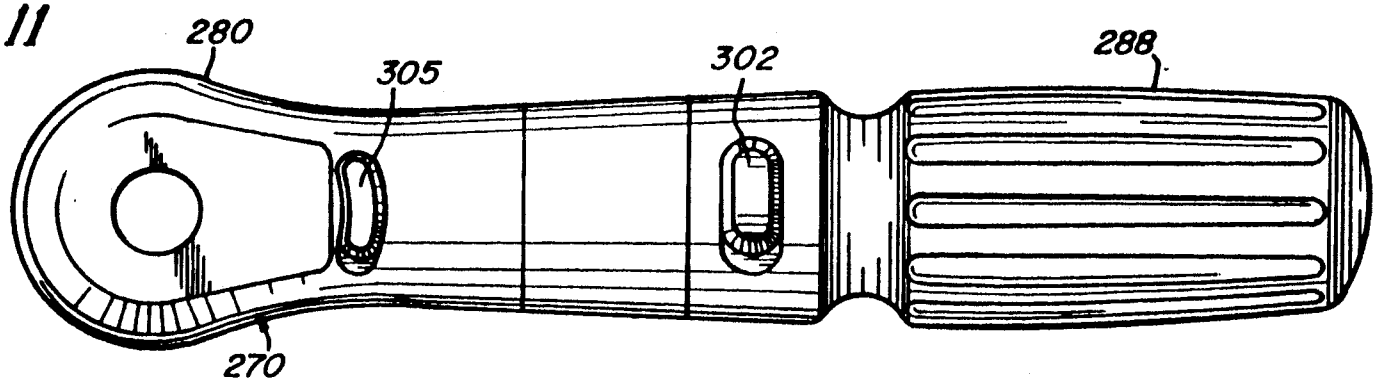
Figure 12:
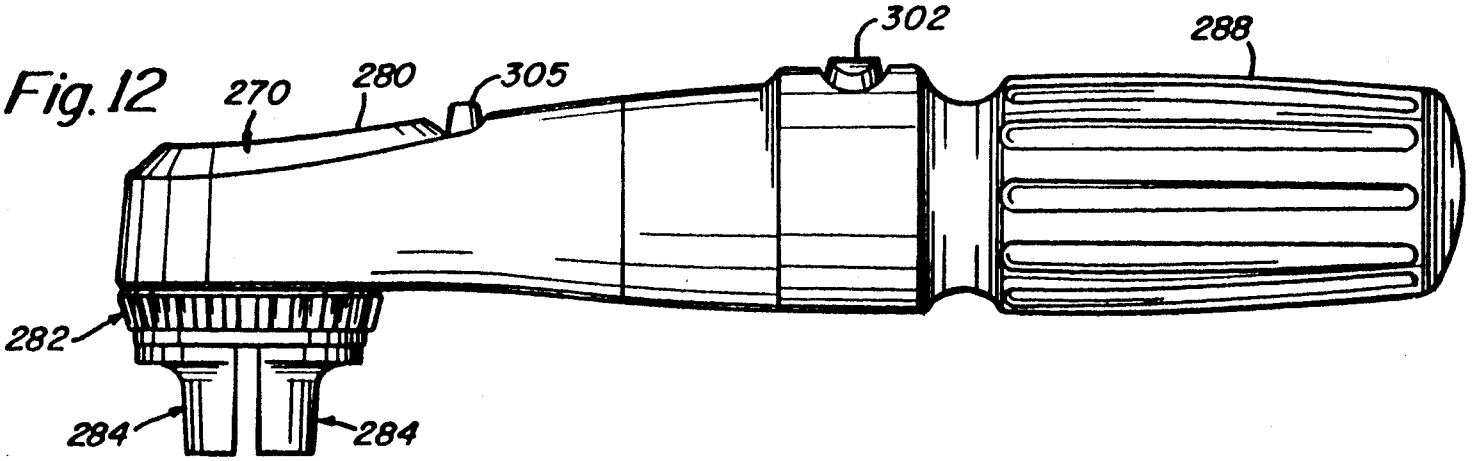
Figure 13:
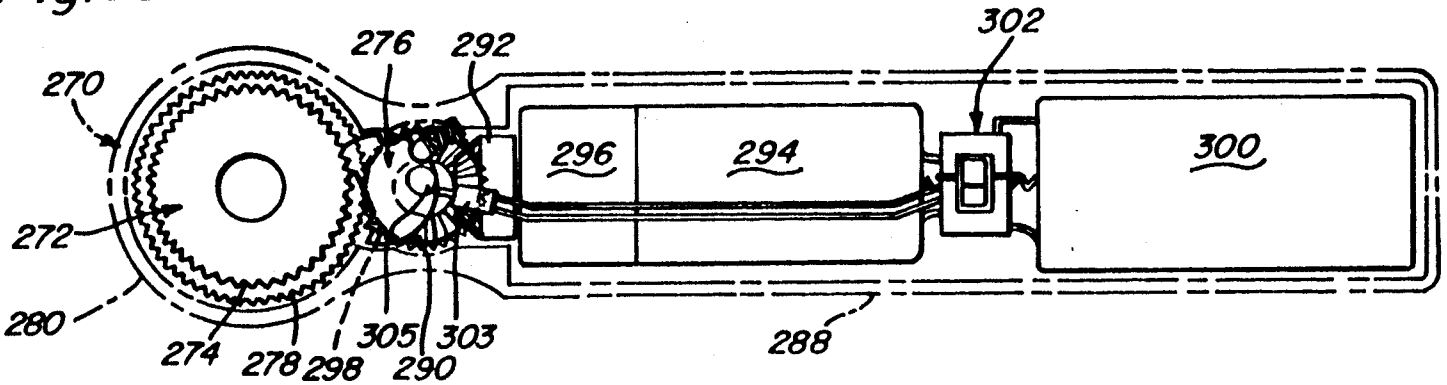
Figure 14:
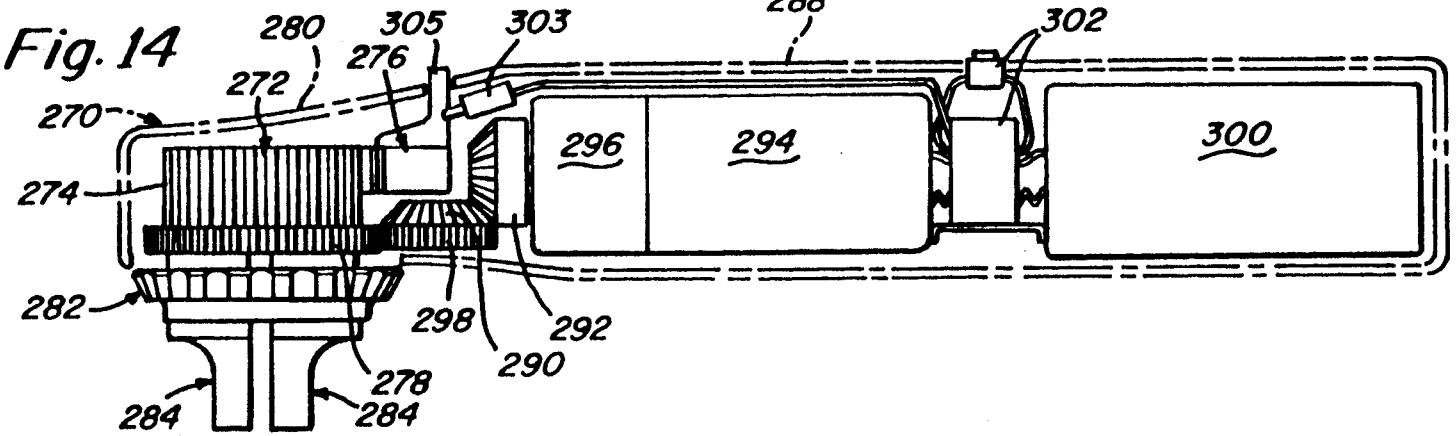
Figure 15:
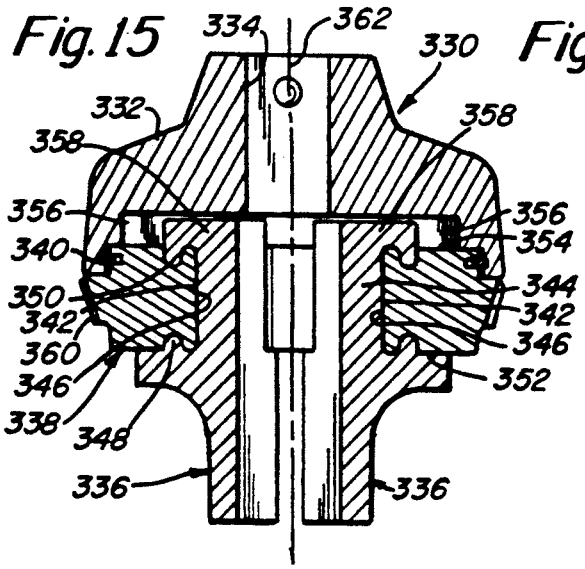
Figure 16:
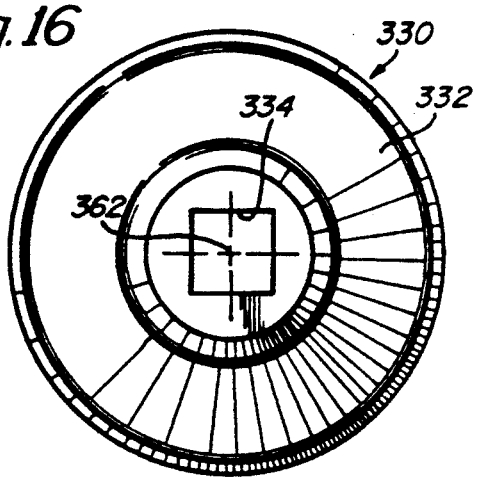

FIGS. 3 and 4 are horizontal cross sectional view of the wrench taken along the section lines 3—3 and 4—4 in FIG. 2, respectively;

FIG. 5 is a cross sectional view of another ratchet wrench embodying this invention and having a two jaw system;

FIG. 6 is a cross sectional view of the wrench shown in FIG. 5 taken along section line 6—6 in FIG. 5;

FIG. 7 is a fragmentary cross sectional view of one form of a ratchet type adjusting disk loading device that may be employed in any of the embodiments of this invention;

FIG. 8 is a fragmentary bottom plan view of a control disk and housing and particularly showing the ratchet gear that forms part of the loading device of FIG. 7;

FIGS. 9 and 10 are fragmentary cross-sectional views of a second form of loading device and showing the ratchet in the operative and in operation positions, respectively;

FIGS. 11 and 12 are pictorial top and side views of a power driven adjustable ratchet wrench embodying this invention;

FIGS. 13 and 14 are diagrammatic top and side views of the wrench shown in FIGS. 11 and 12 and with the casing of the wrench shown in broken lines;

FIG. 15 is a cross sectional view of yet another embodiment of an adjustable wrench head particularly designed for use with a square drive;

FIG. 16 is a top plan view of the wrench head shown in FIG. 15; and

Figure 17:
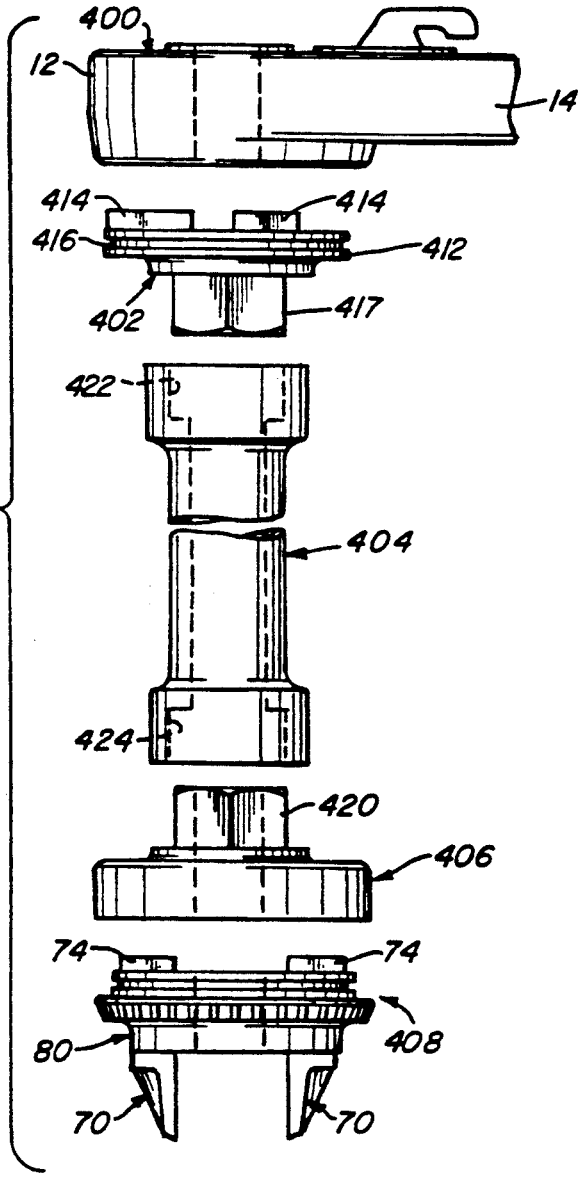

FIG. 17 is an exploded view of yet another embodiment of this invention.

DETAILED DESCRIPTION

In the following description this invention is described under appropriate headings as it is embodied in a variety of different tools. The first embodiment shows the invention incorporated into a ratchet wrench, and the entire tool is disclosed in detail. Many of the other embodiments are described only as they differ from the first embodiment.

Adjustable Ratchet Wrench

The adjustable ratchet wrench 10 shown in FIGS. 1–4 includes a shallow housing 12 integrally formed with a handle 14 that extends radially from the housing. The wrench has a ratchet mechanism 16 which is controlled by a lever 18 disposed on the top of the handle 14 where the handle merges into the housing.

The housing 12 has a shallow chamber 20 open at the bottom as shown at 22. The housing 12 also has an opening 24 in the housing top wall 27. The openings 22 and 24 of the housing are coaxial with one another and with the axis 26 of the chamber 20.

A control disk 28, annular in shape with a central opening 30, is coaxially disposed in chamber 20. The disk 28 on its bottom surface 32 has three radial slots 34 as shown in FIG. 4 that extend from the central opening 30 of the disk to its periphery 36. The periphery of the disk 28 above the slots 34 has a circular gear 38 formed therein having vertically oriented teeth 40 about its periphery. The circular gear 38 is part of the ratchet mechanism 16 for keying the control disk 28 to the housing 12 and handle 14.

Figure 1:
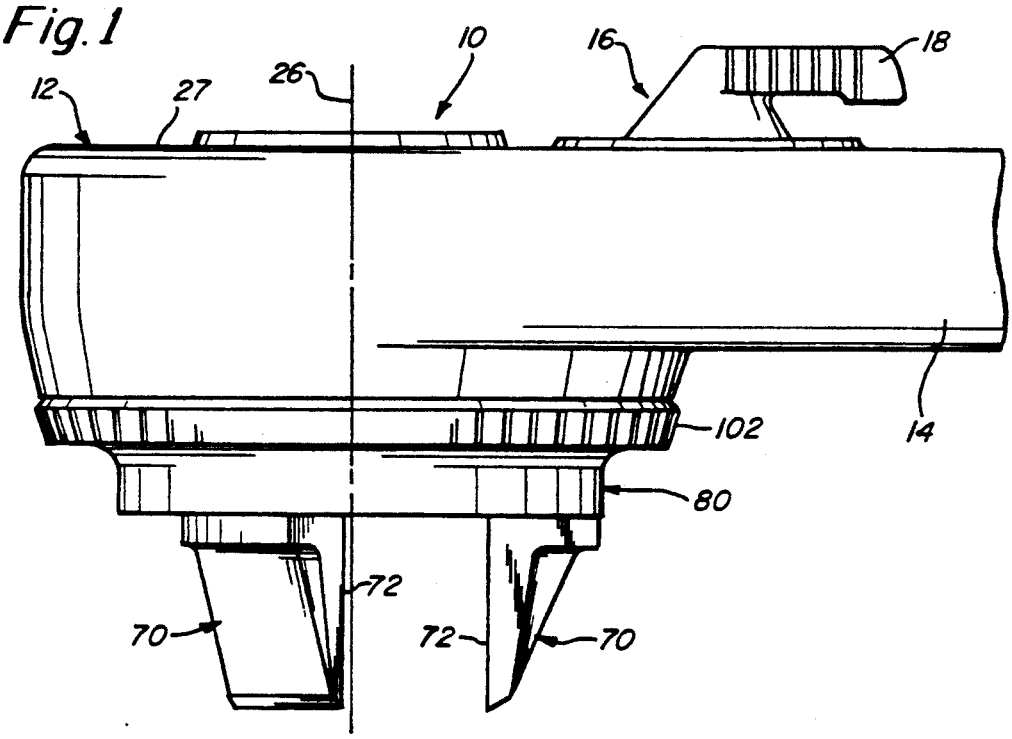
FIG. 1 is an enlarged view of a ratchet wrench having a three jaw system embodying this invention and with the handle of the wrench broken away.

The ratchet mechanism 16 is shown in detail in FIGS. 1 and 4. The ratchet mechanism includes a pawl 46 disposed in a well 48 formed in the handle 14 at the region where the handle merges into the housing. The well is open at one side to the chamber 20 (see FIG. 4) so that the two sets of teeth 50 and 52 on the pawl may selectively engage the circular gear 38 on the control disk 28. The pawl 46 is retained in each of the two positions wherein one or the other of the sets of teeth 50 and 52 engages the circular gear 38 by means of the ball detent 54 disposed in cavity 56 communicating with the well 48 and formed in the handle. As shown in FIG. 4, a pair of notches 58 and 60 are formed in the side of the pawl 46 opposite the sets of teeth 50 and 52, and each notch is sized to receive the ball 62 of the detent 54. The ball 62 is biased to extend out of the cavity 56 by spring 64, which causes the ball to engage either notch 58 or 60 depending upon which registers with the cavity 56. If the ball detent 62 registers with the notch 60 in the pawl 46 it yieldably urges the set of teeth 52 in the pawl into engagement with the circular gear 38. When the pawl is turned from the position shown in that figure so that the ball 62 engages the other notch 58, the teeth 50 rather than teeth 52 in the pawl will engage the circular gear 38. The lever 18 which may be readily gripped between the thumb and forefinger enables the person using the tool to change the working direction of rotation of the ratchet wrench. With the pawl 46 in the position shown in FIG. 4, counterclockwise rotation of the housing 12 and handle 14 about the axis 26 will cause the control disk 28 to rotate with the handle. However, when the handle is turned in the opposite direction (clockwise), the teeth 52 will ride over the teeth 40 of the circular gear 38 and will not turn the control disk 28 with the housing. When the position of the pawl 46 is altered so that the teeth 50 engage the circular gear, clockwise rotation of the housing and handle will cause the control disk 28 to turn with it. However, counterclockwise rotation of the housing and handle will not do so.

In the embodiment of this invention shown in FIGS. 1–4, three jaws 70 having inner flat gripping faces 72 facing the axis 26 are disposed beneath the control disk 28, and each has a rib 74 along the top that extends into one of the slots 34 on the bottom surface of the control disk. The three jaws 70 are supported by an adjusting disk 80 disposed below the control disk 28 and that surrounds the waists 82 of the jaws. Each jaw has a flange 84 which engages the lower edge 86 of the adjusting disk 80 below the waist 82, and the upper ends of the jaws defined by the ribs 74 extend over the upper surface 88 of the disk 80. The jaws are prevented from falling off the inner face of the disk 80 by the fingers 90 that serve as cam followers in arcuate cam tracks 92 formed in the upper surface 88 of the adjusting disk 80 as is described more fully below and shown in FIG. 3.

The cam tracks 92 converge toward the axis 26 from their outer ends 94 to their inner ends 96 as they extend circumferentially in the plate 80 (see FIG. 3). Therefore, as the adjusting disk 80 rotates with respect to the housing 12, the cam tracks 92 will urge the jaws either toward or away from the axis 26 because the cam followers 90 lie in the cam tracks 92 but the jaws will not turn with the adjusting disk 80 but are confined to radial movement because the ribs 74 lie in the radial slots 34 of the control disk 28.

A second set of cam surfaces 100 is provided on the inner edge of the adjusting disk 80, and they each engage the outer surfaces 93 of the waists 82 of the jaws 70. The surfaces 93 also serve as cams and compliment the cam surfaces 100. The cam surfaces 93 and 100 parallel the cam slots 92 and therefore cooperate with the cam slots to move the jaws inwardly as the adjusting disk 80 is turned counterclockwise as viewed in FIG. 3. The cam surfaces 100 not only serve to move the jaws inwardly in cooperation with the cam slots 92 under counterclockwise rotation of the adjusting disk 80 but further serve as the major loading bearing walls of the wrench to support and stabilize the jaws against the outwardly directed forces applied to the jaws by workpieces such as a bolt or nut engaged by jaw faces 72. The adjusting disk 80 as shown in FIG. 1 has a ribbed collar 102 which is easily grasped by the user of the tool so that it may be readily turned to adjust the positions of the jaws 70.

The adjusting disk 80 is supported on the housing 12 by the retaining ring 104 that lies in the opposed annular recesses 106 and 108 formed in the housing 12 and adjusting disk 80, respectively. The retaining ring 104 holds the adjusting disk 80 in place while permitting free rotation of it. A similar retaining ring 110 retains pawl 16 in the well 48 by virtue of its registration with the opposed slots 112 and 114 in the collar 116 of the pawl and the upper wall 118 of the housing.

Two Jaw System

In the embodiment described above and shown in FIGS 1–4, three jaws are provided in the tool, each having flat gripping faces 72 for engaging the workpieces. In FIGS. 5 and 6 a ratchet wrench having a two jaw system is shown. In the two jaw tool, the control disk, adjusting disk and ratchet mechanism all operate in the same fashion as the embodiment of FIGS. 1–4. However, because only two jaws are employed, the guiding slots in the control disk and the cams provided in the adjusting disk are modified, although essentially only in their number. In FIG. 5, the housing 200 is shown to contain the control disk 202 on the bottom surface of which are two opposed slots 204 aligned with one another and which receive the ribs 206 on the tops of the jaws 208.

Each of the jaws 208 has a V shaped gripping face 210 composed of flat surfaces 212 and 214 that diverge from one another away from a shallow recess 216 at the line of intersection of the planes of the surfaces (see FIG. 6). The included angle between the surfaces is 120° so that each of the opposed jaws may engage two adjacent faces of an hexagonal nut, bolt or other workpiece. The recesses 216 at the intersections of the jaw surfaces will protect the corners of the hexagonal member engaged by the jaws from being scarred or rounded when a torque is applied by the jaws to the work.

It will be noted in FIG. 6 that two cam surfaces 220 are provided on the adjusting disk 224 that engages the waist 226 of the jaws 208. The cam surfaces 220 engage the mating cam surfaces 232 on the waist of each jaw so that rotation of the adjusting disk 224 causes the jaws to move toward or away from the axis of the tool.

As in the first embodiment, downwardly extending fingers 236 are provided on the outer radial ends of the ribs 206 of the jaws, which extend downwardly into the cam tracks 238 in the upper surface of the adjusting disk 224. The cam tracks 238 parallel the cams 220 and 232 on the inner surface of the adjusting disk and outer surface of the waists of the jaws so as to maintain the jaws with their faces 210 parallel to the tool axis.

In this embodiment, a third cam system is provided to maintain the jaws in proper alignment. It will be noted in FIG. 5 that an upwardly extending finger 240 is formed in each of the jaws beneath the waist and parallel to the finger 236 on the rib 206, and each finger 240 extends into a cam track 242 formed in the lower surface 244 of the adjusting disk 224, which mirrors the cam tracks 238 on the top of the adjusting disk 224.

Ratchet for Adjusting Disk

In FIGS. 7–10 two different arrangements are shown for yieldably loading the adjusting disk 80 so as to prevent unintentional rotation of it, which would alter the position of the jaws. In the embodiment of FIGS. 7 and 8 the device is shown as it may be applied to the ratchet wrench of FIGS. 1–4.

In FIG. 8 an arcuate ratchet gear 120 is shown on the bottom surface of the control disk 28 between two of the slots 34 that receive and guide the ribs 74 of the jaws. The ratchet gear 120 is concentric with the axis 26 of the tool. In FIG. 7 a pawl 122 is shown disposed in a recess 124 in the adjusting disk 80, and the pawl is urged upwardly by the spring 126 that surrounds the stem portion 128 of the pawl. The pawl is provided with teeth 130 in its upper surface which engage the ratchet gear 120 in the lower surface of the control disk 28. The pressure of the spring 126 urging the pawl teeth 130 to engage the ratchet gear 120 is sufficient to prevent accidental turning of the adjusting disk which could loosen the jaws 70. The pawl and ratchet gear will also resist any tendency for the jaws to open in response to forces applied against their gripping faces by the workpiece engaged by the jaws. At the same time the spring is flexible enough so that when the operator intentionally rotates the adjusting disk 80, the teeth 130 in the pawl will ride over the ratchet gear 120 so as to enable the jaws to be moved when the tool is to be tightened on or loosened from the workpiece engaged by the jaws.

In FIG. 9 and 10, a different pawl arrangement is shown for loading the adjusting disk 80 against undesirable rotation which would loosen the jaws on the workpiece. In this embodiment a pawl 140 is disposed in a recess 142 in the adjusting disk 80. Like the pawl 122, the pawl 140 has a stem 144 surrounded in part by a coil spring 146. The pawl 140 is guided for reciprocal motion in the recess 142 by the complimentary dimensions of the two in the regions of the head 143 and stem 144 of the pawl. A slot 148 is provided in the stem 144 which in turn receives the stem 150 of lock button 152. A pair of mating ramps 154 and 156 are provided in the stems 144 and 150, respectively, and the ramps cause the pawl 140 to be withdrawn into the recess 142 when the lock button 152 is depressed as shown in FIG. 10. This action will cause the teeth 141 on the upper surface of the pawl to disengage the ratchet gear 120 in the bottom surface of the control disk 28 so that the adjusting disk 80 may rotate freely to adjust the positions of the jaws. When the lock button 152 is released, the spring 146 will push the pawl upwardly so that its teeth 141 will reengage the gear 120 and prevent the adjusting disk from rotating. At the same time the ramps 154 and 156 will cause the lock button to return to its extended position.

Power Driven Adjustable Ratchet Wrench

In my co pending application Ser. No. 07/567,290 one embodiment of the wrench is provided with a power handle for automatically driving the work engaged by it. The adjustable wrench of the present invention is also suitable for use with a power handle.

In the embodiment of FIGS. 11–14 an adjustable wrench is shown having a head 270 which is essentially the same as the head of the power tool shown in FIGS. 5 and 6. The tool includes a control disk 272 having a circular gear 274 on its outer surface that is positioned to be engaged by the pawl 276 in the same manner as the pawl 16 of the ratchet mechanism shown in FIG. 4. Disposed beneath the circular gear 274 and within the housing 280 is a circular drive gear 278. The circular drive gear 278 may be integral with or rigidly fixed to the control disk 272 and does not turn independently of it. Beneath the control disk 272 is an adjusting disk 282 provided with cam surfaces identical to those in the adjusting disk 224 of the embodiment of FIGS. 5 and 6. The adjusting disk 282 in turn supports a pair of V-shaped jaws 284 that move radially toward and away from one another in response to rotation of the adjusting disk 282. A pair of slots (not shown) in the lower surface of the control disk 272 contain the ribs (not shown) formed on the upper ends of the jaws to limit the travel of the jaws to a radial direction with respect to the control disk. This structure is the same as the structure described above in connection with the earlier embodiments and is not shown again.

A pair of beveled gears 290 and 292 that engage one another are disposed in handle 288 where it merges with the head 270. The beveled gears are driven by a DC motor 294 through a planetary gear reduction unit 296 all disposed in the handle, and the beveled gear 290 in turn has a circular gear 298 that engages the circular gear 278 attached to and forming part of the control disk 272.

The DC motor is driven by a rechargeable battery pack 300 also disposed in the handle, and the battery pack and DC motor are connected through a switch 302 which turns the motor on and off. The polarity of the motor is controlled through the switch 303 which in turn is manually controlled by the pawl lever 305. The pawl 276 and the direction of motor rotation are thus coordinated so that when manual operation of the tool is used after the resistance of the work to rotation overcomes the motor, the tool will be in condition for this change simply by shutting off switch 302 as is more fully explained below.

As in the other embodiments of this invention, the position of the jaws is controlled by the adjusting disk 282. When that disk is turned in one direction, the jaws will close upon any work disposed between them, and when the disk 282 is rotated in the opposite direction, the jaws open, all under the influence of the cams in the disk 282 acting on the mating cam surfaces provided in the jaws.

The power driven tool of FIGS. 11–14 may be operated either manually or automatically by the power system contained in the handle. If the tool is to be operated manually, the power switch 302 is placed in the off position and the position of pawl 276 is set by means of the pawl lever 305 to determine the rotational driving direction of the tool. The jaws are opened and closed by rotation of the adjusting disk 282. When the wrench is to be automatically powered, the motor is turned on by switch 302, which will cause the beveled gears to rotate the circular drive gear and control disk 272 and turn the jaws and work engaged by them. By reversing the polarity of the motor 294 by means of the switch 303 controlled by the pawl lever 305, the work may be rotated in the opposite direction. When the task is completed, the jaws may simply be opened by rotating the adjusting disk 282 in the manner described above.

The torque which the power handle is capable of exerting on the work through the jaws is limited, and to tighten the workpiece it normally is necessary to complete the task by turning the wrench manually. Typically the power handle will very rapidly drive a nut down a threaded stud until it engages the surface against which it is to be tightened, and at that point the operator will shut off the motor by throwing switch 302. The pawl will be set in the proper position, as described above, due to its use in setting the switch 305, so that manual operation may proceed without further adjustment of the tool. The tool may be used in the manual mode as a conventional ratchet wrench.

Adjustable Wrench Head With Square Drive

The adjustable wrench head shown in FIGS. 15 and 16 is a modification of the head shown in FIGS. 5 and 6. The modified head is designed to be driven by a variety of square drive products. In this embodiment the ratchet is eliminated and the control disk serves not only as the control for the jaws but, in addition, serves as the means for connecting the head to the square drive. As is shown in FIG. 15, the adjusting head 330 has a bell shaped control disk 332 having an axially extending square recess 334 sized to receive standard square drive products such as handles with standard ratchet square drives, standard square drive extension bars etc. In this embodiment, a pair of V shaped jaws 336 are carried by the control disk 332 by means of the adjusting disk 338 which is keyed to the control disk 332 by the retaining ring 340.

The jaws 336 may be identical to those shown in the embodiment of FIGS. 5 and 6 and the adjusting disk 338 may also be identical with the adjusting disk of that embodiment. Thus, the cam surfaces 342 are provided on the outside of the waist 344 of the jaws, which in turn mate with the cam surfaces 346 in the adjusting disk 338. In addition, upwardly and downwardly extending fingers 348 and 350, respectively are disposed in cam slots in the lower and upper surfaces 352 and 354 of the adjusting disk to stabilize the jaws.

A downwardly open radial slot 356 is provided in the control disk 332, which receives the ribs 358 on the jaws to confine their motion to a radial direction as the adjusting disk 338 is turned. It will be appreciated that when the adjusting disk is turned by engagement of the ribbed face 360, the jaws 336 will move radially inwardly o outwardly with respect to the head axis 362 because of the restriction imposed on their motion by the slot 356 in the control disk 332 which engages the jaws.

It will be appreciated that the wrench head shown in this embodiment may be engaged by any square drive so as to rotate the jaws to turn the work engaged by them. The entire assembly shown in FIG. 15 will rotate together with the square drive, and the jaws may be opened or closed on the work merely by turning the adjusting disk.

Adjustable Wrench Modular System

In FIG. 17 an exploded view of yet another embodiment of this invention is shown. It includes all the parts of the adjustable wrench shown in FIGS. 1–4 (or FIGS. 5 and 6 depending upon the number of jaws desired) plus three additional parts as described in detail below, and it will selectively function as either an extension wrench similar to the extension wrench in my co pending application Ser. No. 07/392,206 or as an adjustable ratchet wrench as in the embodiments of FIGS. 1–4 and 5–6.

This embodiment will best be appreciated with reference to FIGS. 1 and 2 as well as the exploded view of FIG. 17. The major elements of the system are the ratchet housing 12 with handle 14, which includes the control disk 28, collectively identified by reference 400; additional parts comprising modular drive 402, extension member 404 and modular cover 406; and wrench head 408 which is identical to and includes the adjusting disk 80 and jaws 70 of the embodiment of FIG. 5. It will be appreciated that by removing the retaining ring 104 (see FIG. 2), the housing 12 and control disk 28 may be separated from adjusting disk 80 and jaws 70 to provide the top and bottom components of the array of parts shown in FIG. 17.

The modular drive 402 includes circular body 412 with three ribs 414 and a retaining ring slot 416 that fit into the open bottom of the housing 12 in place of the removed adjusting disk and may be retained in the housing by the retaining ring 104. In that position the ribs 414 key the drive module to the control disk 28. The drive module also has a hexagonal collar 417 that depends from the body 412.

The module cover 406 is very similar to the combination control disk and cover 332 in the embodiment of FIG. 15. However, it has a hexagonal collar 420 that extends coaxially upwardly at its top. Just like the disk and cover 332, it includes a slot (not shown) at the bottom to receive the ribs (not shown) on the top of the jaws and a retaining ring slot to match the slot in the adjusting ring to receive a retaining ring to keep the two assembled together.

Finally, the extension member 404 has open hexagonal sockets 422 and 424 to receive the collars 417 and 420 on the module drive 402 and module cover 406, respectively, to join all the parts of the modular extension wrench together. It will be noted that all the parts of the assembly have open centers. Consequently the workpiece engaged by the jaws can be threaded down upon an elongated bolt or stud without interference. The tool can be operated as a conventional extension wrench and the ratchet handle and housing provide convenient manual operation. Furthermore, the readily adjustable jaws allow the tool to be used both as an extension wrench and ratchet wrench on a wide variety of metric and standard sizes of nuts, bolts and other workpieces.

From the foregoing description it will be evident that the various embodiments of the adjustable wrench of this invention are very easy and convenient to use and provide a tool that can be used for a variety of purposes and can accommodate the most popular sized nuts and bolts from a range of 5/16ths inch to 1 inch as well as all the metric and standard sizes within the range. It will also be appreciated that because in all of the embodiments of this invention with the exception of the square drive of FIGS. 15 and 16, the tools are open at the center above the jaws, the threaded portion of a bolt or stud onto which a nut is being turned may extend through or into the tool so as to provide the same versatility as a deep bolt socket wrench.

The tool in each of its forms is very easy and convenient to operate because the jaws, whether they be 2, 3 or any other number may be simultaneously adjusted by the adjusting disk. Furthermore, in the ratchet wrench embodiments of the invention, the simple control provided at the top in the form of the pawl handle allows the user to readily change the pawl setting so that the tool may drive the workpiece in a clockwise or counterclockwise direction as desired. Regardless of the setting of the ratchet, the jaws may be easily opened or closed by rotating the adjusting disk. The adjusting disk loading device in either of the forms shown in FIGS. 7–10 may be incorporated into any of the tools to assure that the jaws will not be forced open under the influence of reactive forces applied to them by the workpiece when torque is applied.

The open center configuration of the ratchet wrench embodiment of FIGS. 1–4 and 5–6 allow the tool to be used very effectively with many different accessories. For example, the device may be used in combination with a screwdriver having a rotatable handle with the shaft extending through the open center of the tool. In a similar fashion, an automobile lug wrench may be used with the handle extending through the center of the tool.

Those skilled in the art will appreciate that numerous modifications made be made in this invention. Therefore, it is not intended that the scope of the invention be limited to the several embodiments illustrated and described. Rather, its scope is to be determined by the appended claims and their equivalents.

I claim:

1. An adjustable wrench comprising a housing and a handle secure to the housing, said housing having a top and bottom and an axis and being open at the bottom, said open bottom being concentric with the axis, a first annular disk concentrically mounted in the housing and rotatable about the axis, a plurality of radial slots in the disk and a circular gear on its periphery, a pawl on the handle for selectively engaging the circular gear to cause the first disk to rotate with the handle and housing, a plurality of jaws extending out the bottom of the housing and each engaging one of the slots of the disk so that the jaws may move only radially with respect to the disk, a second disk concentrically secured to the housing and rotatable therewith below the first disk, and cam means formed in the second disk for simultaneously moving the jaws radially inwardly and outwardly as controlled by the slots when the second disk is rotated in the housing.

2. An adjustable wrench as defined in claims 1 wherein the cam means includes a first set of cams for moving the jaws radially inwardly when the second disk is rotated in one direction and a second set of cams for moving the jaws radially outwardly when the second disk is rotated in an opposite direction.

3. An adjustable wrench comprising a housing and a handle secured to the housing, said housing having a top and bottom and an axis and being open at the bottom, said open bottom being concentric with the axis, a first annular disk concentrically mounted in the housing and rotatable about the axis, a plurality of radial slots in the disk and a circular gear on its periphery, a pawl on the handle for selectively engaging the circular gear to cause the first disk to rotate with the handle and housing, a plurality of jaws extending out the bottom of the housing and each engaging one of the slots of the disk so that the jaws may move only radially with respect to the disk, a second disk concentrically secured to the housing and rotatable therewith below the first disk, cam means including a first set of cams for moving the jaws radially inwardly when the second disk is rotated in one direction and a second set of cams for moving the jaws radially outwardly when the second disk is rotated in an opposite direction, and said second disk being annular in shape having an opening through the center thereof through which the jaws extend, and the first set of cams defining the margins of the opening.

4. An adjustable wrench as defined in claim 3 wherein the second set of cams are elongated slots in the second disk which having portions that diverge from the axis.

5. An adjustable wrench as defined in claim 4 wherein the pawl includes a body pivotally movable between two positions adjacent the circular gear, two sets of teeth on the pawl selectively engaging the circular gear and said sets preventing rotation of the first disk in opposite directions relative to the housing, and a spring loaded detent means releasably holding the pawl body in either of the two positions.

6. An adjustable wrench as defined in claim 1 wherein the second disk is at least in part disposed below the housing and a gripping surface is provided on the second disk below the housing for turning it to move the jaws.

7. An adjustable wrench head comprising a housing having an axis, a plurality of jaws mounted on the housing and extending beyond the housing parallel to the axis, said jaws having inner and outer surfaces and inner and outer ends, said outer surfaces lying intermediate the ends of the jaws, and adjusting means surrounding the jaws and having radially facing cams continuously engaging the outer surfaces of the jaws for manually moving the jaws toward the axis when the adjusting means is rotated so as to cause the jaws to close about and engage a workpiece placed within them.

8. An adjustable wrench head as defined in claim 7 wherein additional cams are provided in the adjusting means cooperating with the first recited cams for moving the jaws toward and away from the axis.

9. An adjustable wrench head as defined in claim 8 wherein said adjusting means has top and bottom surfaces and said additional cams are tracks provided in at least one of said top and bottom surfaces and said jaws have cam followers that extend into said tracks.

10. An adjustable wrench head as defined in claim 9 wherein said tracks are provided in both the top and bottom surfaces.

11. An adjustable wrench head as defined in claim 8 wherein control means are provided in the head for preventing rotation of the jaws with respect to the housing.

12. An adjustable wrench head as defined in claim 11 wherein coaxial openings are provided in the housing and adjusting means enabling a workpiece engaged by the Jaws to extend through the head.

13. An adjustable wrench head as defined in claim 7 wherein said adjusting means extends out of said housing, and gripping means are carried by the adjusting means enabling a user to turn it to alter the position of the jaws.

14. An adjustable wrench head as defined in claim 13 wherein a retaining ring releasably connects the adjusting means to the housing.

15. An adjustable wrench head as defined in claim 13 wherein the gripping faces are V-shaped and two jaws are provided in the head.

16. An adjustable wrench head as defined in claim 13 wherein three jaws are provided in the head.

17. An adjustable wrench head as defined in claim 11 wherein the means for preventing rotation of the jaws with respect to the housing includes a control means mounted in the housing and having radially oriented slots with respect to the axis, and said jaws have means engaging said radial slots.

18. An adjustable wrench head as defined in claim 17 wherein a ratchet assembly interconnects the control means and the housing.

19. An adjustable wrench head as defined in claim 8 wherein loading means are provided on the adjusting means for resisting rotation of the adjusting means in the housing.

20. An adjustable wrench head as defined in claim 17 wherein loading means are provided on the adjusting means for resisting rotation of the adjusting means in the housing.

21. An adjustable wrench head as defined in claim 20 wherein said loading means include a rack and pawl joining the adjusting means and control means.

22. An adjustable wrench head as defined in claim 21 wherein said loading means further includes a button means for separating the rack and pawl.

23. An adjustable wrench head comprising a housing having an axis, a plurality of parallel jaws having gripping faces facing one another and parallel to the housing axis, said jaws having inner and outer ends and an intermediate portion with the housing surrounding the inner ends, an annular adjusting disk surrounding the jaws at their intermediate portions and having an inner surface facing said intermediate portions and engaging one another and having an upper and lower portion above and below the inner surface with respect to the axis, cam means on the inner surface of the adjusting disk and the intermediate portions of the jaws where they engage one another causing said jaws to move radially with respect to the axis when the adjusting disk is rotated with respect to the jaws, means rotatably mounting the adjusting disk in the housing, and means carried by the jaws engaging the upper and lower portions of the disk for retaining the jaws within the disk.

24. An adjustable wrench head as defined in claim 23 wherein the last recited means are cams and cam follows on the upper and lower portions of the disk and the jaws operatively paralleling the cam means.

25. An adjustable wrench head as defined in claim 23 wherein means including a control disk is disposed in the housing for preventing rotation of the jaws relative to the housing when the adjusting disk is rotated.

26. An adjustable wrench head as defined in claim 25 wherein last recited means are cams and cam follows on the upper and lower portions of the disk and the jaws operatively paralleling the cam means.

27. An adjustable wrench head as defined in claim 24 wherein means are provided in the housing for preventing rotation of the jaws relative to the housing.

28. An adjustable wrench head as defined in claim 27 wherein a square drive rocket is provided in the housing for receiving a square drive for rotating the housing and the jaws.

29. An adjustable wrench head as defined in claim 24 wherein a handle is connected to the housing, means for automatically rotating the jaws is mounted in the handle, and means is provided for alternatively rotating the jaws manually by means of the handle or automatically by the means within the handle.

30. An adjustable wrench head as defined in claim 25 wherein a handle is connected to the housing, means for automatically rotating the jaws is mounted in the handle, and means is provided for alternatively rotating the jaws manually by means of the handle or automatically by the means within the handle.

31. An adjustable wrench head as defined in claim 30 wherein the means in the handle includes a motor and gear means interconnecting the motor and control disk for rotating the jaws.

32. An adjustable wrench head as defined in claim 31 wherein the motor is reversible, a ratchet assembly interconnects the housing and control disk, and means operatively interconnects the ratchet assembly and motor.

33. An adjustable wrench head as defined in claim 23 wherein the jaws are V shaped at their outer ends.

34. An adjustable wrench head as defined in claim 23 wherein three jaws are included in the head.

35. An adjustable wrench head as defined in claim 23 wherein an extension member is removably connected at one end to the housing, and a ratchet wrench is connected to the other end of the extension member.

36. An adjustable wrench head as defined in claim 35 wherein the adjusting disk, housing and extension member are open along the axis.

37. An adjustable wrench comprising a housing and a handle secure to the housing, said housing having a top and bottom and an axis and being open at the bottom, said open bottom being concentric with the axis, a first disk concentrically mounted in the housing and rotatable about the axis, a plurality of radial slots in the disk and a circular gear on its periphery, a pawl connected to the housing for selectively engaging the circular gear to cause the first disk to rotate with the handle and housing, a plurality of jaws extending out the bottom of the housing and each engaging one of the slots of the disk so that the jaws may move only radially with respect to the disk, a second disk concentrically secured to the housing and rotatable therewith below the first disk, and cam surfaces on the second disk for simultaneously moving the jaws radially inwardly and outwardly as controlled by the slots when the second disk is rotated in the housing.

38. An adjustable wrench as defined in claim 37 wherein the housing has an opening at the top concentric with the axis and the first and second disks have openings concentric with the axis for allowing a shaft on which a workpiece is turned by the jaws to extend through the housing.

39. An adjustable wrench as defined in claim 37 wherein the jaws having inner gripping surfaces facing the axis and cam surfaces facing away from the axis and surrounding a portion of the axial extent of the gripping surfaces, and the cam surfaces on the second disk engage the cam surfaces on the jaws.

40. An adjustable wrench as defined in claim 39 wherein the housing has an opening at the top concentric with the axis and the first and second disks have openings concentric with the axis for allowing a shaft on which a workpiece is turned by the jaws to extend through the housing.

41. An adjustable wrench as defined in claim 38 wherein the cam means includes a first set of cams for moving the jaws radially inwardly when the second disk is rotated in one direction and a second set of cams for moving the jaws radially outwardly when the second disk is rotated in an opposite direction.

42. An adjustable wrench as defined in claim 41 wherein the second set of cams are elongated slots in the second disk which having portions that diverge from the axis.

43. An adjustable wrench as defined in claim 37 wherein the pawl includes a body pivotally movable between two positions adjacent the circular gear, two sets of teeth on the pawl selectively engaging the circular gear and said sets preventing rotation of the first disk in opposite directions relative to the housing, and a spring loaded detent releasably holding the pawl body in either of the two positions.

44. An adjustable wrench as defined in claim 38 wherein the second disk is at least in part disposed below the housing and a gripping surface is provided on the second disk below the housing for turning it to move the jaws.

45. An adjustable wrench as defined in claim 38 wherein the wrench has two jaws.

46. An adjustable wrench as defined in claim 45 wherein the jaws each have V-shaped gripping surfaces.

47. An adjustable wrench as defined in claim 38 wherein the wrench has three jaws.

48. An adjustable wrench as defined in claim 37 wherein control means is operatively connected to the second disk for preventing it from rotating relative to the first disk in response to a reactive force applied to the jaws by a workpiece engaged by the jaws.

49. An adjustable wrench as defined in claim 48 wherein the control means interconnects the first and second disks.

50. An adjustable wrench as defined in claim 49 wherein interengaging gears are mounted on the disks.

51. An adjustable wrench as defined in claim 48 wherein the control means may be manually disabled.

52. An adjustable wrench as defined in claim 48 wherein the control means may be overcome by rotating the second disk with respect to the first disk.

53. An adjustable wrench head comprising a housing having an axis, a plurality of jaws mounted on the housing and extending beyond the housing parallel to the axis, said jaws having inner and outer surfaces, a control member in the housing for limiting the jaws to radial travel on the head with respect to the housing, an adjusting member surrounding the jaws and having radially facing cams engaging the outer surfaces of the jaws for moving the jaws radially with respect to the axis when the adjusting member is rotated, and control means operatively connected to the adjusting member for preventing it from rotating relative to the control member in response to reactive force applied to the jaws by a workpiece engaged by the jaws.

54. An adjustable wrench head as defined in claim 53 wherein coaxial openings are provided in the housing, control member and adjusting member for enabling a shaft onto which a workpiece engaged by the jaws is to be turned, to extend through the head.

55. An adjustable wrench head as defined in claim 53 wherein said adjusting member extends out of said housing, and gripping means are carried by the adjusting member enabling a user to turn it to radially move the jaws.

56. An adjustable wrench head as defined in claim 53 wherein the jaws are V-shaped and two are provided on the head.

57. An adjustable wrench head as defined in claim 54 wherein a ratchet assembly interconnects the control member and the housing for selectively releasably locking the control member against rotation relative to the housing.

58. An adjustable wrench head as defined in claim 53 wherein said control means include a rack and pawl joining the adjusting member and control member.

59. An adjustable wrench head as defined in claim 58 wherein said control means further includes a manual actuator for separating the rack and pawl.

60. An adjustable wrench head as defined in claim 53 wherein a square drive socket is provided in the hosing for receiving a square drive for rotating the housing and the jaws.

61. An adjustable wrench head as defined in claim 53 wherein a handle is connected to the housing, means for automatically rotating the jaws is mounted in the handle, and means is provided for alternatively rotating the jaws manually by means of the handle or automatically by the means within the handle.

62. An adjustable wrench head as defined in claim 61 wherein coaxial openings are provided in the housing, control member and adjusting member for enabling a shaft onto which a workpiece engaged by the jaws is to be turned, to extend through the head.

63. An adjustable wrench head as defined in claim 62 wherein the means in the handle includes a motor and gear means interconnecting the motor and control disk for rotating the jaws.

64. An adjustable wrench head as defined in claim 63 wherein the motor is reversible, a ratchet assembly interconnects the housing and control member, and means operatively interconnects the ratchet assembly and motor.

65. An adjustable wrench head as defined in claim 64 wherein there are two jaws and each has a V-shaped gripping surface.

66. An adjustable wrench head as defied in claim 64 wherein three jaws are included in the head.

* * * * *